US006098574A

United States Patent [19]

Arakawa et al.

[11] Patent Number: 6,098,574

[45] Date of Patent: Aug. 8, 2000

[54] METHOD FOR CONTROLLING CHANGING-OVER OF ROTATIONAL DIRECTION OF INTERNAL COMBUSTION ENGINE

[75] Inventors: Yoshinobu Arakawa; Kouji Sasaki; Yoshikazu Tsukada; Hiroyasu Nito, all of Numazu, Japan

[73] Assignee: Kokusan Denki Co., Ltd., Numazu, Japan

[21] Appl. No.: 09/153,643

[22] Filed: Sep. 15, 1998

[30] Foreign Application Priority Data

Sep. 17, 1997 [JP] Japan ..... 9-252379

[51] Int. Cl.[7] ..... F01L 13/02

[52] U.S. Cl. ..... 123/41 E

[58] Field of Search ..... 123/41 E, 41 R

[56] References Cited

U.S. PATENT DOCUMENTS

| | | | |
|---|---|---|---|
| 890,815 | 6/1908 | Stroud | 123/41 E |
| 1,446,109 | 2/1923 | Whaley | 123/41 E |
| 1,560,506 | 11/1925 | Dyer | 123/41 E |
| 2,881,744 | 4/1959 | Fox | 123/41 R |
| 3,189,009 | 6/1965 | Andersen | 123/41 E |
| 3,981,278 | 9/1976 | Harada | 123/41 R |
| 4,038,825 | 8/1977 | Bastenhof et al. | 60/631 |
| 4,651,705 | 3/1987 | Kinoshita | 123/603 |
| 5,036,802 | 8/1991 | D'Amours | 123/41 E |
| 5,161,489 | 11/1992 | Morooka | 123/41 E |
| 5,782,210 | 7/1998 | Venturoli et al. | 123/41 E |
| 5,794,574 | 8/1998 | Bostelmann et al. | 123/41 E |
| 5,964,191 | 10/1999 | Hata | 123/41 E |

*Primary Examiner*—Noah P. Kamen
*Attorney, Agent, or Firm*—Pearne & Gordon LLP

[57] ABSTRACT

A rotational direction change-over control method capable of reversing a rotational direction of an internal combustion engine without discharging unburnt gas. When a reverse command is generated, feed of fuel to the engine is interrupted to reduce a rotational speed of the engine to a set level. An ignition position of the engine is advanced to an excessively advanced position during a reduction in rotational speed to the set level. When the rotational speed is reduced to the set level, feed of fuel is restarted to reverse a rotational speed of the engine. When judgment that the rotational speed is successfully reversed is made, the ignition position is transferred to a position near a top dead center, to thereby maintain rotation of the engine in a direction reversed.

14 Claims, 5 Drawing Sheets

Fig. 2
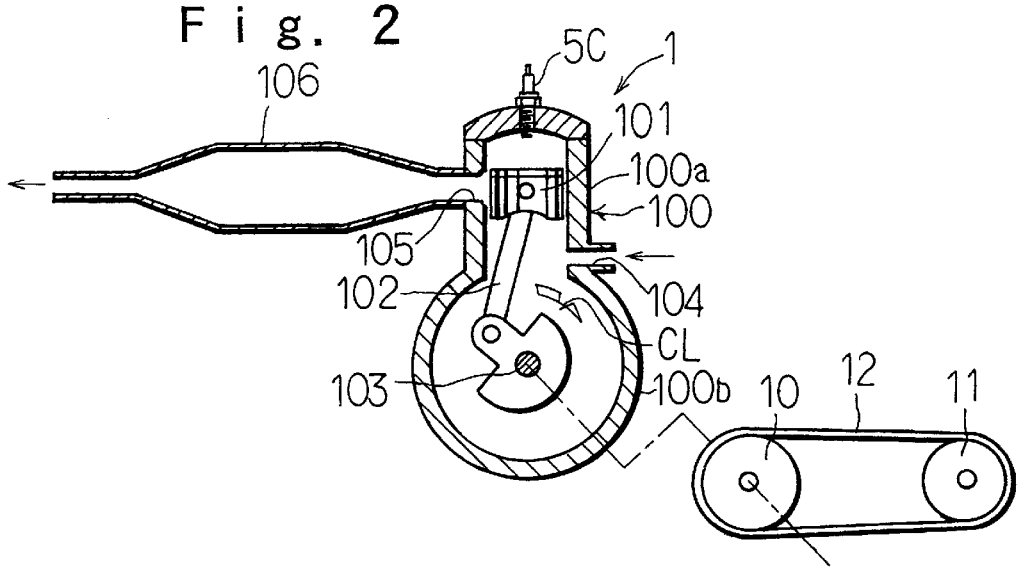
Fig. 3
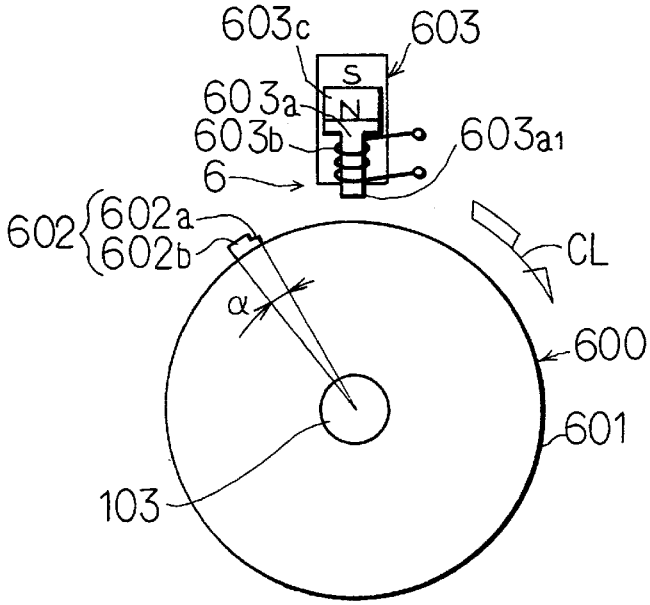
Fig. 4A
Fig. 4B
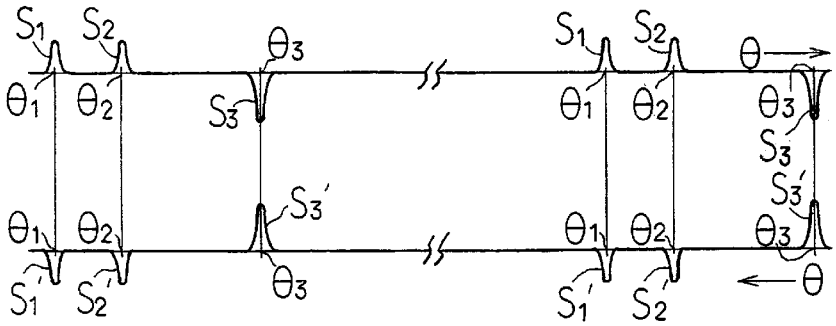

METHOD FOR CONTROLLING CHANGING-OVER OF ROTATIONAL DIRECTION OF INTERNAL COMBUSTION ENGINE

BACKGROUND OF THE INVENTION

This invention relates to a method for controlling changing-over of a rotational direction of an internal combustion engine, and more particularly to a method for controlling changing-over of a rotational speed of a spark-ignition internal combustion engine of the reciprocating piston type.

A vehicle such as a motor scooter, a snowmobile or the like which places importance on simplicity or convenience generally uses a small-sized two-cycle or four-cycle internal combustion engine as a drive source therefor. Also, in the vehicle, a stepless change gear of the centrifugal clutch type is typically used as a power transmission device for transmitting an output of the internal combustion engine to a driving wheel. Such a vehicle places importance on a decrease in size, a decrease in weight and a reduction in cost, so that a stepless change gear which does not include a backgear is typically used for this purpose.

A vehicle which uses a change gear including no backgear fails to move back; so that when it is required to reverse a travel direction of the vehicle in a narrow space, it is needed to lift the whole vehicle by hands. Thus, it is highly deteriorated in operability.

In order to permit a travel direction of the vehicle provided with no backgear to be reversed, it is required to change over or reverse a rotational direction of the internal combustion engine as required.

A method for changing over a rotational direction of an internal combustion engine is proposed in U.S. Pat. No. 5,036,802. The method proposed is so constructed that when it is required to change over a rotational direction of an internal combustion engine, operation of an ignition device is interrupted to deactivate the engine, to thereby reduce a rotational speed of a crank shaft of the engine; thus, ignition operation is carried a out at a sufficiently advanced rotation angle position to force piston back, resulting in a rotational direction of the engine being reversed, when the rotational speed of the crank shaft is reduced to a predetermined level to cause the engine to reach a state right before stopping. Immediately after a rotational direction of the engine is thus reversed, an ignition position of the engine is changed to a rotation angle position suitable for maintaining rotation of the engine in the reversed direction, so that operation of the engine is continued while keeping the rotational direction reversed.

The method proposed in the U.S. patent, as described above, deactivates the engine during a reduction in rotational speed of the engine, to thereby cause a large amount of unburnt gas mainly containing a hydrocarbon component to be discharged while reversing the rotational direction, leading to atmospheric pollution.

Also, the proposed method is constructed so as to restart ignition operation in a state that unburned exhaust gas remains in an exhaust pipe during reversing of a rotational direction of the engine. This causes afterfiring due to firing of the unburned gas in the exhaust pipe, leading to generation of explosive sound sufficient to give a driver anxiety and cause damage to the engine and exhaust pipe.

SUMMARY OF THE INVENTION

The present invention has been made in view of the foregoing disadvantage of the prior art.

Accordingly, it is an object of the present invention to provide a method for controlling changing-over of a rotational direction of an internal combustion engine which is capable of reversing a rotational direction of a crank shaft while eliminating discharge of unburnt gas.

In accordance with the present invention, a rotational direction change-over control method is provided for changing over a rotational direction of a spark-ignition internal combustion engine of the reciprocating piston type including a piston reciprocated in a cylinder and a crank shaft connected to the piston and adapted to be ignited by an ignition unit capable of controlling an ignition position.

The method of the present invention includes a fuel interruption step of interrupting feed of fuel to the internal combustion engine while keeping a degree of opening of a throttle valve at a level near a degree of opening thereof during idling of the engine so that a rotational speed of the engine may be reduced when it is fed with a reverse command for commanding to reverse a rotational direction of the engine, an ignition position transfer step of transferring a position at which the ignition unit carries out ignition operation to an excessively advanced position suitable for reversing a rotational direction of the internal combustion engine during a period of time required to permit a rotational speed of the engine to reach a predetermined level during the fuel interruption step, a rotational direction reverse step of restarting feed of fuel to the internal combustion engine and permitting the ignition unit to carry out ignition operation at the excessively advanced position when a rotational speed of the engine reaches the predetermined level, a rotational direction judgment step of judging whether reversing of a rotational direction of the internal combustion engine is succeeded during the rotational direction reverse step, and an ignition position transfer step of transferring the ignition position to a rotation angle position suitable for maintaining rotation of the internal combustion engine in the reversed direction when success of reversing of the rotational direction is judged in the rotational direction judgment step.

In general, an ignition position of an internal combustion engine is indicated by a rotation angle position of a crank shaft of the engine. The ignition position is varied to a position advanced from a top dead center of the engine or from a rotation angle position of the drank shaft when a piston reaches the top dead center. An ignition position of the engine at each of rotational speeds during steady operation of the engine is set at a position required to permit a predetermined output to be derived from the engine to ensure stable rotation of the engine.

The term "excessive advance" of the ignition position used herein indicates further advance of the ignition position from an appropriate ignition position at each of rotational speeds during steady operation of the internal combustion engine.

The term "interruption of feed of fuel to internal combustion engine" used herein means, in the case of an internal combustion engine fed with fuel from a fuel injector, that a fuel injection rate from the fuel injector is rendered zero. Whereas, in the case of an internal combustion engine fed with fuel from a carbureter, it means interruption of injection of fuel from the carbureter. Feed of air to a cylinder of the engine is continued even when the feed of fuel is stopped.

When feed of fuel to the internal combustion engine is interrupted upon feeding of a reverse command thereto, combustion in the cylinder of the engine is prevented, resulting in a rotational speed of the engine being reduced, during which the ignition position is transferred to the excessively advanced position. When a rotational speed of the engine is reduced to a set level, feed of fuel to the engine is restarted. However, there exists predetermined lag time before an air-fuel ratio of an air-fuel mixture in the cylinder reaches a value which permits ignition of the mixture after feed of fuel is restarted. A rotational speed of the engine is reduced below the set level while the lag time elapses. When an air-fuel ratio of an air-fuel mixture fed to the cylinder of the engine reaches a predetermined value, combustion in the cylinder takes place due to generation of spark for ignition at the excessively advanced position. Combustion which takes place at the excessively advanced position permits generation of force for forcing back a piston. Then, when the force overcomes force of the piston acting to raise the piston toward the top dead center, the engine is reversed. Thus, when the set level for a rotational speed of the engine when feed of fuel is restarted and the excessively advanced position which is an ignition position of the engine are suitably determined, a rotational direction of the engine may be reversed. Also, when it is judged in the rotational direction judge step that a rotational direction of the engine is successfully reversed, the ignition position is transferred to a rotation angle position suitable for maintaining rotation of the engine in the reversed direction, resulting in operation of the engine in the reversed direction being attained.

Also, the present invention, as described above, may be so constructed that interruption of feed of fuel to the internal combustion engine leads to a reduction in rotational speed of the engine and feed of fuel to the engine is restarted when the rotational speed is reduced to the set level. Further, the ignition may take place at the excessively advanced position. Such construction permits a rotational direction of the engine to be satisfactorily changed over substantially without discharge of unburnt gas, to thereby eliminate occurrence of afterfiring and air pollution during changing-over of the rotational direction.

In order to gradually reduce a rotational speed of the internal combustion engine to ultimately reverse a rotational direction of the engine, it may be also employed to gradually advance the ignition position to the excessively advanced position when the reverse command is provided and reverse a rotational direction of the engine when the ignition position reaches a predetermined excessively advanced position. However, such techniques of gradually advancing the ignition position toward the excessively advanced position causes a period of time during which knocking occurs to be increased during advancing of the ignition position, leading to a disadvantage that a period of time during which shock is applied to the piston and crank shaft is increased.

On the contrary, the present invention is constructed so as to interrupt feed of fuel to the internal combustion engine, to thereby reduce a rotational speed of the engine to a set level. This fully prevents occurrence of knocking during a reduction in rotational speed of the engine, resulting in eliminating application of unnecessary shock to the engine during reversing of the rotational direction.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, wherein:

FIG. 2 is a schematic view showing an internal combustion engine to which a method of the present invention may be applied and a change gear arranged between the internal combustion engine and a drive wheel of a vehicle or the like by way of example;

FIG. 3 is a schematic view showing a rotation sensor used for detecting rotation of an internal combustion engine during practicing of a method of the present invention;

FIGS. 4A and 4B each are a waveform diagram showing a signal obtained by the rotation sensor shown in FIG. 3;

DETAILED DESCRIPTION OF THE PREFERRED EMBODIMENT

Now, a method for controlling changing-over of a rotational direction of an internal combustion engine according to the present invention will be described hereinafter with reference to the accompanying drawings.

Figure 1:
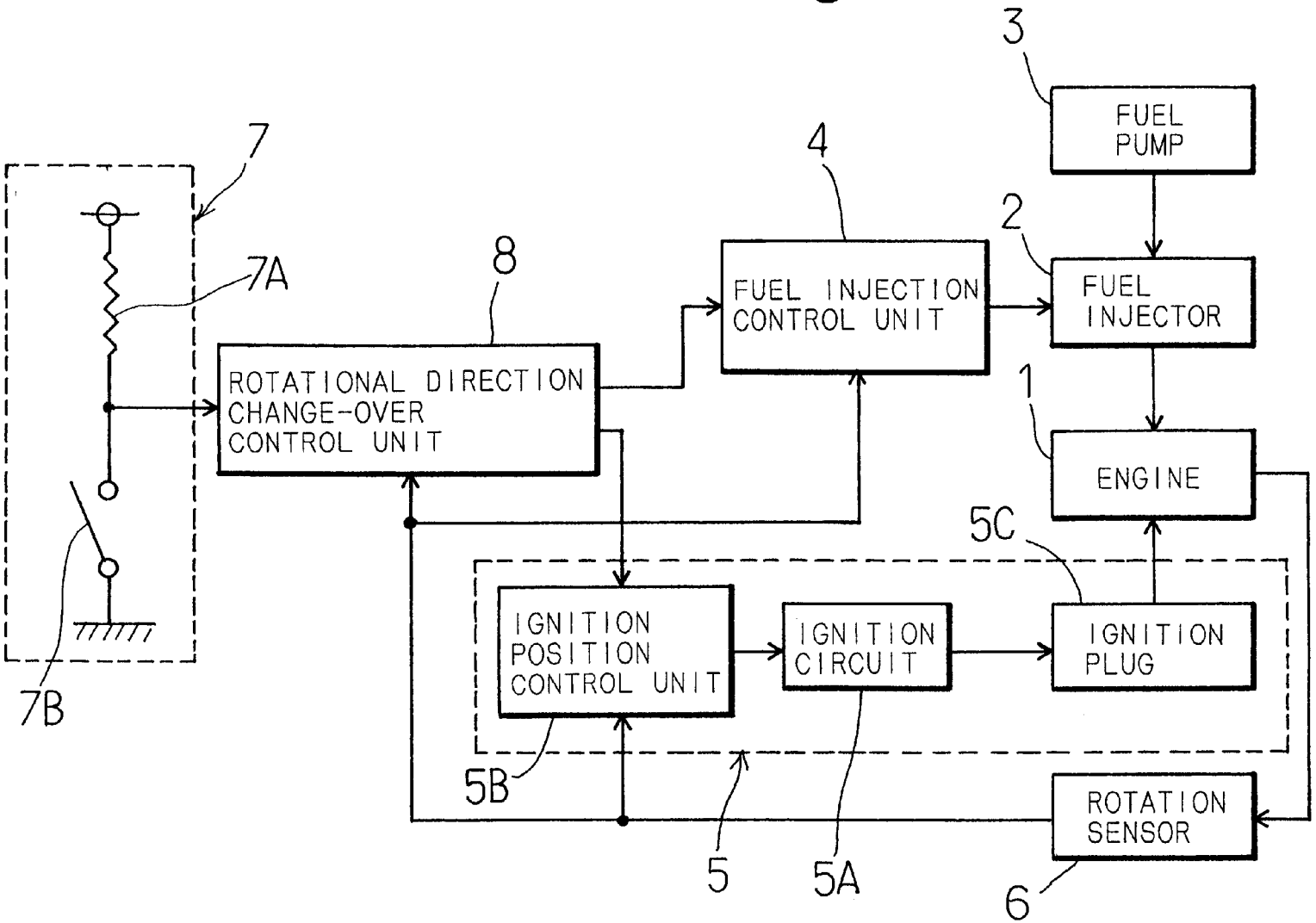
FIG. 1 is a block diagram showing a control system used for practicing a method for controlling changing-over of a rotational direction of an internal combustion engine according to the present invention.

Referring first to FIG. 1, a system for controlling an internal combustion engine suitable for use for executing a method for controlling changing-over of a rotational direction of an internal combustion engine according to the present invention is illustrated by way of example. In FIG. 1, reference numeral 1 designates an internal combustion engine of which changing-over of a rotational direction is to be controlled, 2 is a fuel injector for feeding the internal combustion engine with fuel, 3 is a fuel pump for feeding fuel to the fuel injector 2, 4 is a fuel injection control unit for controlling the fuel injector 2, and 5 is an ignition unit for igniting the internal combustion engine 1. Also, reference numeral 6 designates a rotation sensor for detecting rotation of the internal combustion engine 1, 7 is a reverse command generation section for generating a reverse command, and 8 is a rotational direction change-over control unit for controlling the ignition unit 5 and fuel injection control unit 4 to reverse a rotational direction of the internal combustion engine 1 when the reverse command generation section 7 generates a reverse command.

In the internal combustion engine control system thus constructed, the fuel injection control unit 4, an ignition position control unit 5B and the rotational direction change-over control unit 8 are realized by execution of a predetermined program by a microcomputer. Alternatively, the control units may be realized by means of individual microcomputers, respectively, or may be realized by means of a common single microcomputer.

The internal combustion engine 1 is constructed in the form of a spark-ignition internal combustion engine of the reciprocating piston type which includes a piston reciprocated in a cylinder and a crank shaft connected to the piston. An internal combustion engine to be controlled by the present invention may be either a two-cycle engine or a four-cycle engine. In the illustrated embodiment, it is in the form of a two-cycle engine.

FIG. 2 shows a structure of the internal combustion engine 1 and that of a load which may be employed supposing that the engine is used for driving a snowmobile. The internal combustion engine 1 is constructed into a piston valve type two-cycle engine which includes an engine body 100 including a cylinder 100*a* and a crank casing 100*b*, a piston 101 fitted in the cylinder 100*a*, and a crank shaft 103 connected to the piston 101 through a connecting rod 102. The cylinder 100*a* is provided with an intake port 104, an exhaust port 105 and a scavenging port (not shown) arranged on a rear side of the piston 101. The exhaust port 105 has an exhaust pipe 106 connected thereto. Between a space in the crank casing 100*b* and the scavenging port is provided a scavenging passage for connecting the space and port to each other therethrough. The intake port 104 is connected to an intake manifold (not shown) through a check valve.

In FIG. 2, reference numerals 10 and 11 designate a primary pulley and a secondary pulley which cooperate with each other to constitute a belt-type stepless change gear (CVT), respectively. 12 is a steel belt arranged so as to extend between the pulleys 10 and 11. The pulleys 10 and 11 each are so constructed that a width of a V-shaped groove thereof is varied to vary a position thereof in a radial direction thereof on a contact point of an inclined plane between the pulley and the belt 12. The primary pulley 10 is mounted on the crank shaft 103 and driving wheels of a snowmobile are mounted on a revolving shaft of the secondary pulley 11.

The primary pulley 10 is connected to a centrifugal clutch mechanism. The centrifugal clutch mechanism functions to increase a width of the above-described V-shaped groove engaged with the belt to keep the belt 12 undriven when a rotational speed of the crank shaft of the internal combustion engine is below a predetermined level. Also, it functions to reduce a width of the V-shaped groove to render the belt 12 driven and vary the radial position of the contact point on the inclined plane between the belt 12 and the pulley 10 as described above, when the rotational speed is within a range exceeding the predetermined level. The secondary pulley 11 is likewise adapted to vary a width of the V-shaped groove thereof engaged with the belt 12 depending on a rotational speed of the crank shaft and functions to vary the position on the inclined plane between the pulley 11 and the belt 12 depending on a rotational speed of the crank shaft, to thereby vary a reduction ratio between the primary pulley 10 and the secondary pulley 11.

Herein, rotation of the crank shaft 103 in a clockwise direction indicated at an arrow CL in FIG. 2 is defined to be normal rotation and that in a counterclockwise direction is defined to be reverse rotation.

The fuel injector 2 shown in FIG. 1 may include, for example, a valve body provided at a distal end thereof with an injection port, a valve for operating the injection port and an electromagnet for driving the valve, wherein the valve body is fed with fuel under a predetermined pressure from the fuel pump 3. The fuel injector 2 functions to keep the valve open while the electromagnet is fed with a drive current, resulting in fuel being injected into a space in an intake manifold of the internal combustion engine, a space (combustion chamber) in the cylinder and the like. A fuel injection rate or a rate at which fuel is injected from the fuel injector 2 is determined by a product of a pressure of fuel fed from the fuel pump to the valve body and a period of time during which the valve is kept open. In general, in order to control the fuel injection rate during a period of time for which the valve of the fuel injection valve 2 is kept open, a pressure of fuel fed from the fuel pump 3 to the fuel injection valve 2 is kept constant.

The fuel injection control unit 4 functions to control a timing at which a drive current is fed to the fuel injector 2 and a period of time during which the drive current is fed to the fuel injector 2 to control a fuel injection rate of the fuel injector 2 depending on various conditions for control such as a temperature of the engine, an intake air temperature, an atmospheric pressure, a degree of opening of a throttle valve, a rotational speed of the engine, a reverse command and the like.

The ignition unit 5 includes an ignition circuit 5A for generating a high voltage for ignition when it is fed with an ignition signal, the above-described ignition position control unit 5B for feeding an ignition signal to the ignition circuit 5A at an ignition position of the internal combustion engine, and an ignition plug 5C mounted on the cylinder of the internal combustion engine 1.

The ignition circuit 5A includes an ignition coil and a primary current control circuit for drastically varying a primary current flowing through the ignition coil when it is fed with an ignition signal, so that a drastic variation in primary current of the ignition coil permits a high voltage for ignition to be induced across a secondary winding of the ignition coil. The ignition circuit 5A may be constituted by a circuit of the capacitor discharge type, a circuit of the current interruption type or the like which is known in the art. In the illustrated embodiment, the ignition circuit 5A is not limited to any specific type so long as it permits the ignition position control unit 5B to output a high voltage for ignition in response to an ignition signal which the ignition position control unit 5B generates at an ignition position of the internal combustion engine.

The ignition position control unit 5 is equipped with a microcomputer and functions to obtain information on a rotational speed of the engine and that on a rotation angle thereof from a signal generated by the rotation sensor 6, to thereby operate an ignition position of the engine depending on various control conditions such as a rotational speed of the engine, a temperature thereof, a reverse command and the like, resulting in the ignition circuit 5A being fed with an ignition signal when the ignition position operated is detected.

The ignition plug 5C is connected to an output terminal of the ignition circuit 5A, to thereby generate spark to ignite the engine when the ignition circuit 5A generates a high voltage for ignition.

For the purpose of executing the control method of the present invention, a suitable rotational direction detecting means is provided to detect a rotational direction of the engine. The rotational direction detecting means may be constituted of, for example, a rotation sensor which is different in pulse generation manner between when the crank shaft of the engine is rotated in one direction and when it is rotated in the other direction and a pulse generation manner identifying means for identifying a manner in which the rotation sensor generates a pulse signal.

The rotation sensor 6 shown in FIG. 1 is constructed so as to be different in a manner to generate a pulse signal between when the cranks shaft of the engine is rotated in one direction and when it is rotated in the other direction. Also, it is constructed so as to generate a pulse signal containing information on a rotational speed of the internal combustion engine, a rotation angle thereof and a rotational direction thereof. The rotation sensor may be constituted by, for example, a signal generator of the inductor type constructed as shown in FIG. 3. In FIG. 3, reference numeral 600 designates a rotor including a rotary yoke 601 mounted on the crank shaft 103 of the engine and a two-stage inductor 602 constituted of projections and/or recesses formed on an outer periphery of the rotary yoke 601. The two-stage inductor 602 includes a first section 602*a* positioned in proximity to one end thereof in a peripheral direction thereof and a second section 602*b* positioned in proximity to the other end thereof, wherein the second section 602*b* is formed into a height larger than that of the first section 602*a* and an arcuate length or a length in a peripheral direction thereof larger than that of the first section 602*a*. In the illustrated embodiment, the rotor 600 is so arranged that the first section 602*a* of the two-stage inductor 602 is positioned forwardly in a rotational direction of the rotor 600 when it is normally rotated. The yoke 601 may be constituted by a flywheel mounted on the engine or the like.

Reference numeral 603 designates a signal generating element arranged so as to face the outer periphery of the rotor 601 and mounted on a stationary section of the engine such as a casing thereof or the like. The signal generating element 603 includes a core 603*a* provided at a distal end thereof with a pole section 603*a*1, a signal coil 603*b* wound on the core 603*a,* and a permanent magnet 603*c* magnetically coupled to the core 603*a* and therefore may be constructed in a manner known in the art. The signal generating element 603 is so arranged that the pole section 603*a*1 faces the outer periphery of the rotor 600 through a gap of a predetermined distance.

The signal generator shown in FIG. 3 permits a magnetic flux interlinking the signal coil 603*b* to be increased when the first section 602*a* of the inductor 602 is rendered opposite to the pole section 603*a*1 of the signal generating element during normal rotation of the internal combustion engine and to be further increased when the second section 602*b* of the inductor 602 is rendered opposite to the pole section 603*a*1 of the signal generating element.

The signal coil 603*b* generates pulse signals different in polarity from each other when a magnetic flux interlinking the signal coil 603 is increased and reduced, respectively.

FIGS. 4A and 4B each show relationship between a rotation angle θ of the engine and a waveform of each of pulse signals induced across the signal coil 603*b* while the engine is normally and reversely rotated. The signal coil 603*b* generates pulse signals S1 and S2 of one polarity (a positive polarity in the illustrated embodiment) at a position of an angle θ1 at which the first section 602*a* of the inductor starts to be opposite to the pole section of the signal generating element and at a position of an angle θ2 at which the second section 602*b* of the inductor starts to be opposite to the pole section of the signal generating element, respectively, and generates a pulse signal S3 of the other polarity (a negative polarity in the illustrated embodiment) at a position of an angle θ3 at which the second section 602*b* of the inductor terminates opposition to the pole section of the signal generating element.

The signal coil 603*b* also generates a pulse signal S3' of a positive polarity at a position of an angle θ3 at which the second section 602*b* of the inductor is rendered opposite to the pole section of the signal generating element and generates signals S2' and S1' of a negative polarity at a position of an angle θ2 at which the second section 602*b* of the inductor terminals opposition to the pole section of the signal generating element and at a position of an angle θ1 at which the first section 602*a* of the inductor terminals opposition to the pole section of the signal generating element, respectively.

The position at which each of the pulse signals is generated is strictly a position at which the pulse signal reaches a threshold level or a level which a circuit receiving the pulse signal can recognize. However, a signal width of the pulse signal is very narrow. Thus, in FIG. 4, a peak position of the pulse signal is defined to be the position of generation of the pulse signal for convenience.

As described above, the signal generator shown in FIG. 3 is different in both signal polarity induced across the signal coil and order of generation thereof between during normal rotation of the engine and during reverse rotation thereof, so that identification of both a polarity of each of signals generated from the signal coil and the order of generation of the signals permits a rotational direction of the engine to be judged.

The rotation sensor 6 and the pulse generation manner identifying means may cooperate with each other to constitute the rotational direction detecting means described above.

The illustrated embodiment may be so constructed that when the signal coil 603*b* generates pulse signals in order of the positive polarity pulse S1, positive polarity pulse S2 and negative polarity pulse S3, normal rotation of the engine is judged; whereas when the signal coil generates pulse signals in order of the positive polarity pulse S3', negative polarity pulse S2' and negative polarity pulse S1', reverse rotation of the engine is judged.

Also, an interval of generation of the pulses or a period of time between generation of the pulse signals S1 and that of the pulse signal S3 may be used for detecting a rotational speed of the engine.

Suitable setting of a polar arcuate angle a of the inductor 602 and arrangement of the signal generating element 603 which permits a central position of the inductor 602 in a peripheral direction thereof to be opposite to a center of the pole section of the signal generating element 603 permit the pulse signals S1 and S3' to be generated at a symmetric position of α/2 before a top dead center of the internal combustion engine during normal rotation of the engine and reverse rotation thereof, respectively, so that positions of generation of the signals S1 and S3' may be defined to be a minimum advanced position of an ignition position of the engine during the normal rotation and that during the reverse rotation. The term "minimum advanced position" used herein means, of ignition positions of the engine during steady operation thereof, an ignition position closest to the top dead center. Normally, it is an ignition position during idling of the engine. The polar arcuate angle a of the inductor 602 may be set to be, for example, 10 degrees. Supposing that the polar arcuate angle a is set to be 10 degrees, the minimum advanced position during each of normal rotation and reverse rotation or the ignition position during idling is set to be 5 degrees before the top dead center.

An angle at which a position of generation of each of the pulse signals is determined or a rotation angle of the crank shaft of the internal combustion engine is required to be measured on the basis of a fixed position. Normally, the position of generation of each pulse signal is measured on the basis of the top dead center of the engine.

The pulse signals generated from the rotation sensor 6 each are converted into a signal recognizable by the microcomputer by means of a waveform shaping circuit (not shown) and then fed to a predetermined input port of the microcomputer.

The microcomputer obtains information on a rotation angle of the engine, that on a rotational speed thereof and that on a rotational direction thereof from the signals fed from the rotation sensor, as well as information on an intake air temperature, a temperature of the engine (a temperature of cooling water), a degree of opening of the throttle valve, an atmospheric pressure and the like from outputs of various sensors (not shown), resulting in attaining processing for realizing each of the fuel injection control unit 4, ignition position control unit 5B and rotational direction change-over control unit 8.

In the embodiment shown in FIG. 1, the reverse command generation section 7 includes a resistor connected at one end thereof to an output terminal of a constant-voltage DC power circuit (not shown) on a positive polarity side thereof and a switch 7B for a reverse command connected between the other end of the resistor 7A and the ground. The constant-voltage DC power circuit has an output terminal on a negative polarity side thereof grounded and an output voltage applied across a series circuit of the resistor 7A and switch 7B. The reverse command generation section 7 has an output terminal led out of a connection between the resistor 7A and the switch 7B, so that a signal obtained between the output terminal and the ground is inputted to the microcomputer (not shown) to feed a reverse command to the rotational direction change-over control unit 8. For example, the switch 7B is kept turned off during normal rotation of the engine and turned on during reverse rotation thereof. Alternatively, the switch 7B may be kept turned on during the reverse rotation and turned off during the normal rotation.

A signal generated by the reverse command generation section 7 is kept at a high level when the switch 7B is kept turned off and at a zero level when it is kept turned on. The rotational direction change-over control unit 8 makes judgment that a reverse command which commands to reverse a rotational direction of the engine every time when a signal fed from the reverse command generation section is varied in level is provided.

Reversing of a rotational direction of the engine is carried out by operating a throttle operation member such as a throttle lever or the like to set a degree of opening of the throttle valve to a minimum level or a level near the minimum level (a level near a degree of opening thereof during idling of the engine), resulting in operating the switch 7B of the reverse command generation section 7.

The rotational direction change-over control unit 8 changes over various kinds of control (control of the ignition unit and fuel injector) carried out by the microcomputer to a control mode during the reversing, to thereby permit it to attain processing for reversing of the engine.

Preferably, first of all, a fuel interruption step of interrupting feed of fuel to the internal combustion engine to reduce a rotational speed of the engine to a set level is carried out while a degree of opening of the throttle valve is kept minimum when the reverse command is generated. Also, in parallel to the fuel interruption step, an ignition position transfer step of transferring a position at which the ignition unit carries out ignition operation to an excessively advanced position suitable for reversing a rotational direction of the engine is carried out during a period of time required for reducing a rotational speed of the internal combustion engine to the set level. Then, when a rotational speed of the engine is reduced to the set level or the fuel interruption step is terminated, a rotational direction reverse step of restarting feed of fuel to the internal combustion engine and permitting the ignition unit to carry out ignition operation at the excessively advanced position. Also, concurrently with the rotational direction reverse step, a rotational direction judgment step is executed for judging whether reversing of a rotational direction of the internal combustion engine is succeeded. When judgment that the reversing of the rotational direction is succeeded is made, the ignition position is transferred to a rotation angle position suitable for maintaining rotation of the internal combustion engine in the reversed direction.

Figure 5:
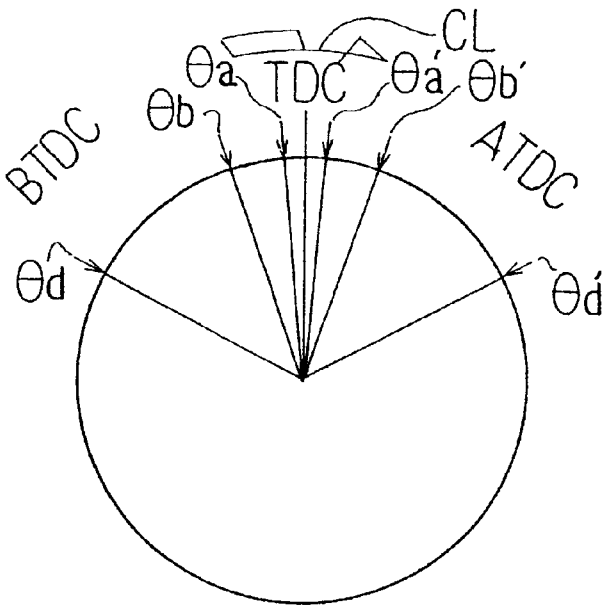
FIG. 5 is a diagrammatic view showing a variation in ignition position of an internal combustion engine during each of normal rotation thereof and reverse rotation thereof.

FIG. 5 shows relationship between an ignition position of the internal combustion engine and a rotation angle thereof, wherein an arrow CL designates a direction of normal rotation of the engine and TDC is a top dead center of the engine or a rotation angle position of the crank shaft when the piston is at the top dead center. When the internal combustion engine is being rotated in the direction CL, the ignition position is in an advance range during the steady operation defined between a position θa slightly advanced from the top dead center TDC and a position θb further advanced therefrom, wherein the ignition position is varied in the advance range depending on a variation in rotational speed of the engine. A range further advanced from the advance range is defined to be an excessive advance range, wherein a position indicated at θd is an excessively advanced position.

Also, a range defined between θa' and θb' is an advance range during the steady operation defined when the internal combustion engine is being rotated in a direction opposite to the direction CL. θd' indicates an excessively advanced position obtained when a rotational direction of the engine being reversely rotated is reversed. In FIG. 5, BTDC indicates a rotation angle range advanced from the top dead center TDC and ATDC indicates a rotation angle range delayed from the top dead center.

Figure 6A:
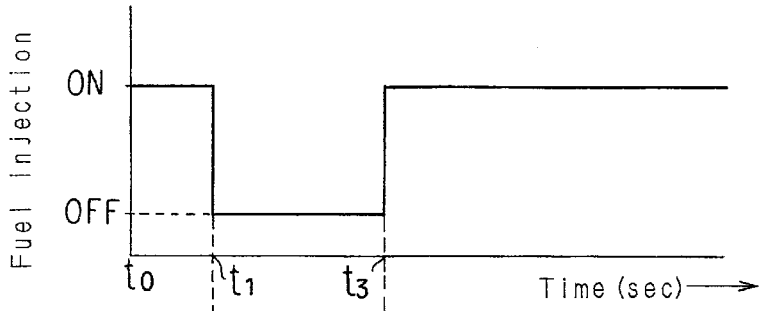
FIG. 6A is a diagrammatic view showing a variation in fuel injection to time in an embodiment of the present invention.
Figure 6B:
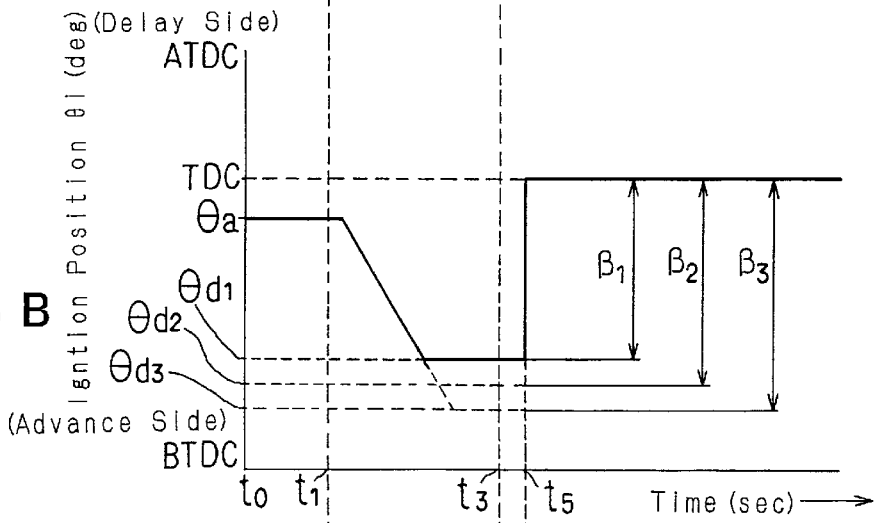
FIG. 6B is a diagrammatic view showing a variation in ignition position of an internal combustion engine to time in an embodiment of the present invention.
Figure 6C:
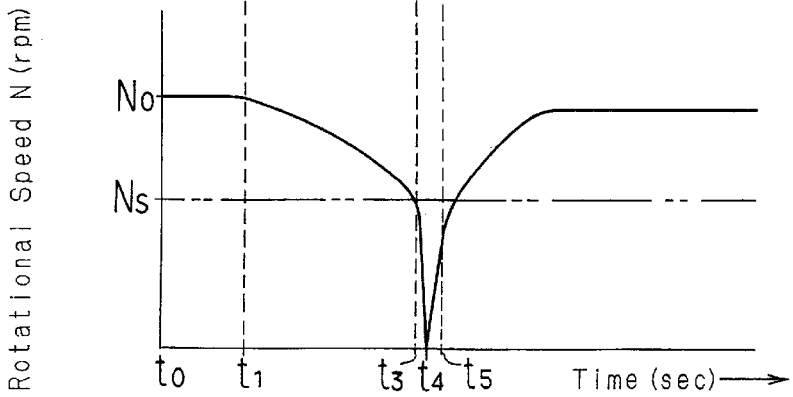
FIG. 6C is a diagrammatic view showing a variation in rotational speed of an internal combustion engine to time in an embodiment of the present invention.

Now, variations in fuel injection, ignition position and rotational speed of the internal combustion engine which are preferably obtained in the present invention when a rotational direction of the engine being normally rotated is reversed will be described with reference to FIGS. 6A to 6C by way of example, wherein FIG. 6A shows a variation in fuel injection to time t and FIG. 6B shows a variation in ignition position θi to the time t. FIG. 6C shows a variation in rotational speed N to the time t.

When the throttle valve is throttled to a minimum level at time t0 shown in FIGS. 6A to 6C in order to reverse rotation of the internal combustion engine, an ignition position θi of the engine is defined at the position θa closest to the top dead center within the advance range during the steady operation and a rotational speed of the engine is set at an idling speed No.

Then, when it is fed with a reverse command at time tl, a fuel injection rate of the fuel injector 2 is rendered zero, so that the fuel interruption step is initiated. In the fuel interruption step, combustion in the cylinder does not take place, so that a rotational speed of the engine is reduced as shown in FIG. 6C.

In order to eliminate discharge of unburnt gas, it is desired that the ignition operation is continued during the fuel interruption step as well.

The ignition position θi is gradually advanced immediately after the reverse command is fed at the time t1, resulting in being transferred to an excessively advanced position θdx (x=1, 2, 3 . . . ) while the fuel injection rate is kept zero or the fuel interruption step is executed.

Then, fuel injection is restarted when a rotational speed of the internal combustion engine is reduced to a set level or value Ns, resulting in the fuel interruption step being terminated and then the rotational direction reverse step is started. In the example shown in FIGS. 6A to 6C, it is supposed that fuel is injected into an intake pipe or a crank casing in a two-cycle engine. This causes predetermined lag time to occur before an air-fuel ratio of an air-fuel mixture in a cylinder reaches a value sufficient to permit ignition of the mixture after feed of fuel is restarted at the time t3. A rotational speed N of the engine is further reduced exceeding the set value Ns while the lag time elapses. Once an air-fuel ratio of an air-fuel mixture fed to the cylinder of the engine reaches the predetermined value, combustion takes place in the cylinder when spark for ignition is generated at the excessively advanced position θdx.

Figure 7:
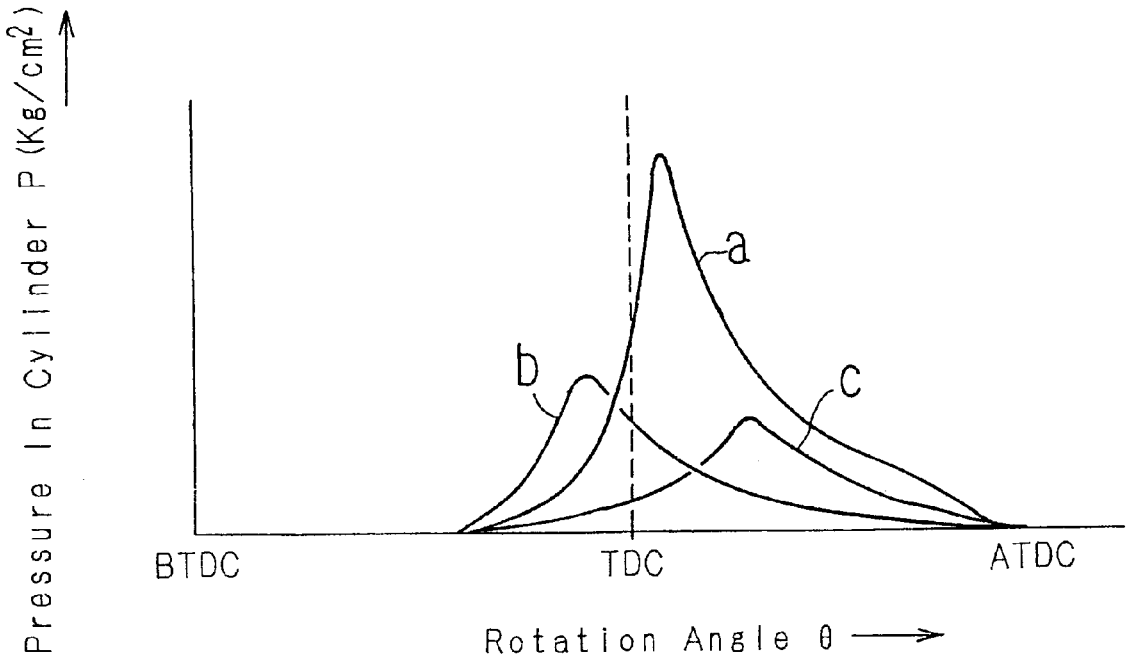
FIG. 7 is a graphical representation showing relationship between a pressure in a cylinder of an internal combustion engine and a rotation angle thereof.

FIG. 7 shows relationship between a rotation angle θ of the internal combustion engine and a pressure P in the cylinder, wherein a curve a indicates that the ignition takes place at an appropriate position and a curve b indicates that the ignition takes place at a position advanced from the appropriate position. Also, a curve c indicates the ignition which takes place at a position delayed from the appropriate position. As will be noted from FIG. 7, transfer of the ignition position toward the excessively advanced position causes a pressure in the cylinder during the ignition operation to be reduced, so that a position at which a pressure in the cylinder is increased to a maximum level after the ignition is deviated toward the advanced position or away from the top dead center TDC of the engine. This causes force acting to force back the piston to be increased with advance of the ignition position, so that when the force acting to force back the piston overcomes force of the piston acting to lift the piston toward the top dead center at time t4, a rotational direction of the engine is reversed.

In the present invention, the set level Ns of the rotational speed and the excessively advanced position θdx which is the ignition position just after restarting of fuel feed are determined so that a rotational direction of the engine may be reversed when an air-fuel ratio of the air-fuel mixture is returned to an ignitable value or a value sufficient to permit ignition of the mixture, resulting in combustion taking place after feed of fuel is restarted.

In order to minimize a period of time required before the air-fuel ratio is returned to the ignitable value after feed of fuel is restarted, the fuel injection rate when feed of fuel is restarted is preferably set to be larger than the fuel injection rate during idling of the engine.

In an internal combustion engine of the direct injection type wherein fuel is injected directly into a cylinder or a combustion chamber, an air-fuel mixture is rendered ignitable immediately when feed of fuel is restarted, resulting in combustion being attained by ignition operation taking place first after restarting of fuel feed, so that a rotational direction of the engine may be rapidly reversed.

At the time when feed of fuel is restarted at the time t3, the order of output pulses generated by the rotation sensor 6 is identified, so that the rotational direction judge step for judging a rotational direction of the engine may be executed. When the rotational direction judge step judges at time t5 that the rotational direction is successfully reversed, the ignition position is transferred to a rotation angle position suitable for maintaining rotation of the internal combustion engine in the direction in which the ignition position is reversed. In the illustrated embodiment, the rotation angle position is defined at the top dead center TDC. This permits rotation of the engine in the reversed direction to be maintained.

An advance quantity βx in which the ignition position is advanced to the excessively advanced position θdx is suitably selected depending on a temperature of the air-fuel mixture. In an internal combustion engine, the higher a temperature of an air-fuel mixture is, the higher a propagation velocity of a flame produced due to ignition of fuel is, so that a period of time required before explosive force applied to the piston reaches a maximum level after the ignition may be reduced. Thus, when it is desired that the ignition position is stepwise advanced toward the excessively advanced position to reverse a rotational direction of the engine, the advance quantity βx in which the ignition position is excessively advanced is preferably reduced as indicated at β1 in FIG. 6B to obtain an excessively advanced position θd1 in the case that a temperature of an air-fuel mixture during reversing of the engine is increased. Whereas, when the temperature is decreased, the advance quantity is desirably increased as shown at β3 in FIG. 6B, to thereby obtain an excessively advanced position θd3.

As described above, a variation in magnitude of the advance quantity βx from the top dead center to the excessively advanced position depending on a temperature of the air-fuel mixture is carried out by arranging at least one of an engine temperature sensor for detecting a temperature of the internal combustion engine and an intake air temperature sensor for detecting that of intake air of the engine, to thereby vary the excessively advanced position θdx depending on a temperature detected by the temperature sensor in a manner to increase the advance quantity by which the ignition position is excessively advanced when the temperature detected is reduced.

The method of the present invention described above permits a rotational direction of the internal combustion engine to be reversed while substantially eliminating discharge of unburnt gas, to thereby prevent afterfiring and air pollution during reversing of the rotational direction.

A rotational speed of the engine during reversing of the rotational direction is extensively low and stable, thus, it is not necessarily easy to judge whether a rotational direction of the engine is successfully reversed when an ignition position of the engine is at the excessively advanced position θdx. Thus, the rotational direction judge step of judging whether or not reversing of a rotational direction of the engine is succeeded is preferably executed after the ignition position is transferred from the excessively advanced position to the ignition position reversed.

For this purpose, the fuel interruption step of interrupting feed of fuel to the internal combustion engine while keeping a degree of opening of the throttle valve at a level near a degree of opening thereof during idling of the engine so that a rotational speed of the engine may be reduced to the set level when it is fed with a reverse command for commanding to reverse a rotational direction of the engine, the ignition position transfer step of transferring a position at which the ignition unit carries out ignition operation to the excessively advanced position suitable for reversing a rotational direction of the internal combustion engine during a period of time required to permit a rotational speed of the engine to reach the predetermined level during the fuel interruption step, the rotational direction reverse step of restarting feed of fuel to the internal combustion engine and permitting the ignition unit to carry out ignition operation at the excessively advanced position when a rotational speed of the engine reaches the predetermined level, the rotational direction judgment step of judging whether reversing of a rotational direction of the internal combustion engine is succeeded during the rotational direction reverse step, and the ignition position transfer step of transferring the ignition position to a rotation angle position suitable for maintaining rotation of the internal combustion engine in the reversed direction when success of reversing of the rotational direction is judged in the rotational direction judgment step are executed, to thereby operate the engine while keeping the rotational direction reversed, after success of reversing of the rotational direction is judged in the rotational direction judgment step.

As described above, a rotational speed of the internal combustion engine during reversing of the rotational direction is highly low and stable, therefore, it is not necessarily easy to judge whether or not a rotational direction of the engine is successfully reversed. However, the above-described construction of the present invention that a rotational direction of the engine is confirmed after the ignition position is returned to the top dead center permits judgment of the rotational direction to be facilitated.

The number of times of ignition in the rotational direction reverse step is not the number of times of ignition in each of the cylinders of the internal combustion engine but the number of times of ignition in the whole engine, thus, it is often caused to be smaller than the number of cylinders of the engine.

The number of times of ignition in the rotational direction reverse step is suitably set so as to ensure that a rotational direction of the engine is reversed. An excessive number of times of ignition in the rotational direction reverse step causes the engine to be possibly stopped, thus, the number of times of ignition in the rotational direction reverse step is preferably minimized.

In order to inform a driver of reversing of the engine, it is desired to permit a display means to carry out display operation of indicating reversing of a rotational direction of the engine when the reversing is detected in the rotational direction judge step.

Also, in order to ensure that a rotational direction of the engine is positively reversed, the steps from the fuel interruption step to the rotational direction judgment step are preferably repeated until success in reversing of a rotational direction of the engine is confirmed, when a failure in reversing of the rotational direction is judged in the rotational direction judge step. This permits operation of the engine to be carried out while keeping the rotational direction reversed, after the success is judged.

Figure 8:
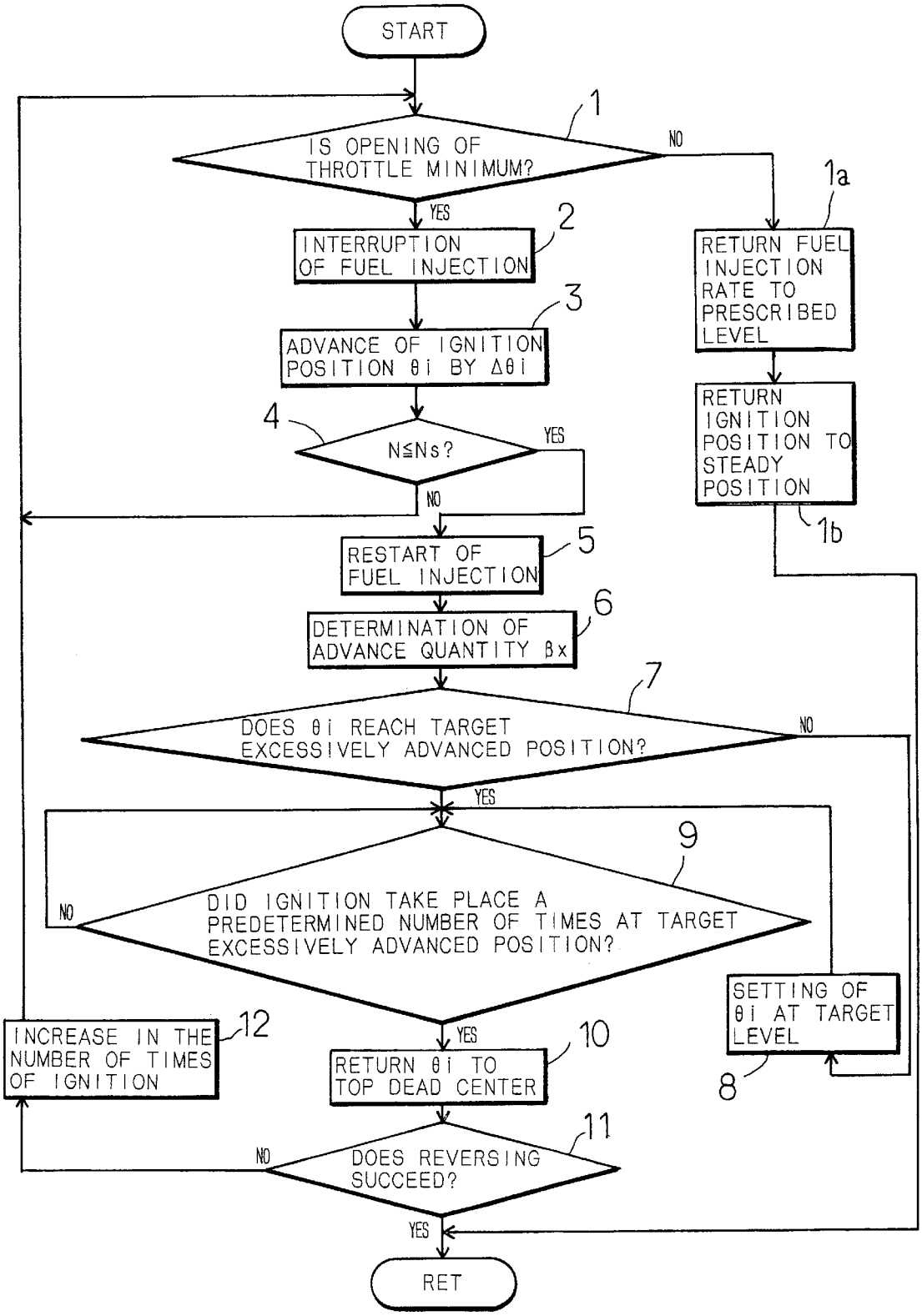
FIG. 8 is a flow chart showing an algorithm of an interruption routine of a program executed by a microcomputer when a reverse command is fed.

FIG. 8 shows an algorithm of an interruption routine executed when a reverse command is provided, which routine is contained in a program executed by a microcomputer in the case that the steps from the fuel interruption step to the rotational direction judgment step are repeated until success in reversing of a rotational direction of the engine is confirmed.

In the case that the algorithm shown in FIG. 8 is employed, whether or not a degree of opening of the throttle is kept minimum is judged in a step 1 when the reverse command is provided. In this instance, when opening of the throttle is not minimum, the fuel injection rate is returned to a prescribed level in a step 1*a* and then the ignition position is returned to a position for steady operation in a step 1*b*, to thereby interrupt operation of reversing a rotational direction of the engine. Then, the procedure is returned to the main routine. When that opening of the throttle is kept minimum is confirmed in the step 1, injection of fuel is stopped in a step 2 and then the ignition position is advanced by a unit quantity $\Delta\theta i$ in a step 3. Thereafter, in a step 4, whether or not a rotational speed N of the engine is reduced to a set value Ns is judged. When the rotational speed N is not reduced to the set level Ns, the procedure is returned to the step 1, so that the steps 1 to 4 are repeated.

When a reduction in rotational speed N of the engine to the set level Ns is judged in the step 4, injection of fuel is restarted in a step 5 and then an advance quantity $\beta x$ which is conformed to a value of an intake air temperature detected by the sensor or an advance quantity from the top dead center to the excessively advanced position $\theta dx$ is determined in a step 6. Then, in a step 7, whether or not the ignition position reaches the target position or excessively advanced position is judged. As a result, when it was found that the ignition position does not reach the excessively advanced position, a step 8 is executed to transfer the ignition position to the target position or excessively advanced position, followed by a step 9. When it is judged in the step 7 that the ignition position already reaches the excessively advanced position, a step 9 is immediately executed.

In the step 9, whether or not a predetermined number of times of ignition takes place at the excessively advanced position is judged. When judgement that a predetermined number of times of ignition takes place is judged, the procedure is advanced to a step 10, so that the ignition position $\theta i$ may be transferred to a position near the top dead center. Transferring of the ignition position to the position near the top dead center permits rotation of the engine irrespective of reversing of a rotational direction of the engine, to thereby prevent interruption of the engine.

After the ignition position is transferred to the top dead center, a step 11 is executed to judge whether or not reversing of a rotational direction of the engine is succeeded. As a result, when it was found that the rotational direction is successfully reversed, the procedure is returned to the main routine. When the step 11 judges that reversing of the rotational direction is failed, the number of times of ignition judged in the step 9 is increased by one, followed by returning of the processing to the step 1, so that the above-described processing is repeated.

In the illustrated embodiment, the steps 2 to 5 cooperate together to constitute the fuel interruption step, and the steps 3, 6, 7 and 8 constitute the ignition position transfer step. Also, the step 9 constitutes the rotational direction reverse step and the steps 10 and 11 provide the rotational direction judgment step.

The above-described construction that the steps extending from the fuel interruption step to the rotational direction judgment step are repeated when reversing of the rotational direction is failed permits the reversing to be positively attained.

Also, when a series of steps extending from the fuel interruption step to the rotational direction judge step is repeated plural times, the number of times of ignition carried out in the rotational direction judge step may be increased every time when the repeating takes place. This ensures that reversing of a rotational direction of the engine is positively attained.

When a failure in reversing of the rotational direction is judged in the step 11 although such a failure is not shown in FIG. 8, a step 12 may be executed in such a manner to advance the excessively advanced position of the ignition position in the next rotational direction reverse step from that in the previous one, other than increase the number of times of ignition in the next rotational direction reverse step.

Also, the step 12 may be so executed that the number of times of ignition carried out in the next rotational direction reverse step is increased by one and the ignition position in the next rotational direction reverse step is further advanced toward the excessively advanced position.

Thus, when a series of steps extending from the fuel interruption step to the rotational direction judge step is repeated plural times while advancing the excessively advanced position every time when the steps are repeated, reversing of a rotational direction of the engine can be positively attained.

The processing shown in FIG. 8 is constructed so as to vary the advance quantity βx between the top dead center and the excessively advanced position θdx depending on an intake air temperature of the engine. Alternatively, it may be constructed so as to vary a magnitude of the advance quantity βx from the top dead center to the excessively advanced position depending on a temperature of the engine (or a temperature of cooling water of the engine) or determine a magnitude of the advance quantity βx depending on both an intake air temperature of the engine and a temperature of the engine.

Further, irrespective of an intake air temperature of the engine and a temperature of the engine, the advance quantity βx may be rendered constant at a value which permits a rotational direction of the engine to be reversed even when a temperature of the air-fuel mixture is reduced.

Moreover, in FIG. 8, the number of times of ignition in the rotational direction reverse step is increased every time when a series of the steps from the fuel interruption step to the rotational direction judge step is repeated. Alternatively, repeating of the steps may be carried out while keeping the number of times of ignition in the rotational direction reverse step constant. In this instance, the step 12 is eliminated.

In the illustrated embodiment, the means for feeding fuel to the internal combustion engine is constituted by the fuel injector. Alternatively, in the present invention, a carbureter may be used for this purpose. When the carbureter is used, interruption of fuel feed may be attained, for example, by closing a valve arranged between a float chamber of the carbureter and a nozzle thereof.

The illustrated embodiment is so constructed that a driver keeps a degree of opening of the throttle valve minimum during reversing of a rotational direction of the internal combustion engine. Instead, in the illustrated embodiment, the throttle valve may be operated by means of an electrically-operated actuator. The actuator may be controlled so as to keep a degree of opening of the throttle valve minimum when the reverse command is fed.

Also, in the illustrated embodiment, the ignition position transfer step is executed so as to gradually advance the ignition position to the excessively advanced position. Alternatively, it may be practiced in a manner to stepwise vary the ignition position to the excessively advanced position.

When a rotational direction of the internal combustion engine is reversed to move the vehicle back, an increase in rotational speed of the engine without any restriction incurs danger. Thus, when the engine is rotated in a direction which permits the vehicle to be backed, it is desired that a rotational speed of the engine is reduced to a predetermined limited value. Such limitation may be attained, for example, by delaying the ignition position when the rotational speed exceeds the limited value.

As can be seen from the foregoing, in the present invention, interruption of fuel feed to the internal combustion engine permits a reduction in rotational speed of the engine, so that when the rotational speed is reduced to the set level, feed of fuel to the engine is restarted. Also, ignition of the engine is carried out at the excessively advanced position. Thus, the present invention ensures positive change-over of the rotational speed while substantially preventing discharge of unburnt gas, to thereby eliminate afterfiring and air pollution during reversing of the rotational direction.

Also, in the present invention, a reduction in rotational speed of the internal combustion engine is carried out by interrupting feed of fuel to the engine. This effectively prevents knocking from occurring during a reduction in rotational speed of the engine, to thereby keep the engine from being unnecessarily shocked during reversing of a rotational direction of the engine.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A rotational direction change-over control method for changing over a rotational direction of a spark-ignition internal combustion engine of the reciprocating piston type including a piston reciprocated in a cylinder and a crank shaft connected to the piston and adapted to be ignited by an ignition unit capable of controlling an ignition position, comprising:

a fuel interruption step of interrupting feed of fuel to the internal combustion engine while keeping a degree of opening of a throttle valve at a level near a degree of opening thereof during idling of the engine so that a rotational speed of the engine may be reduced when it is fed with a reverse command for commanding to reverse a rotational direction of the engine;

an ignition position transfer step of transferring a position at which the ignition unit carries out ignition operation to an excessively advanced position suitable for reversing a rotational direction of the internal combustion engine during a period of time required to permit a rotational speed of the engine to reach a predetermined level during said fuel interruption step;

a rotational direction reverse step of restarting feed of fuel to the internal combustion engine and permitting the ignition unit to carry out ignition operation at the excessively advanced position when a rotational speed of the engine reaches the predetermined level;

a rotational direction judgment step of judging whether reversing of a rotational direction of the internal combustion engine is succeeded during said rotational direction reverse step; and an ignition position transfer step of transferring the ignition position to a rotation angle position suitable for maintaining rotation of the internal combustion engine in the reversed direction when success of reversing of the rotational direction is judged in said rotational direction judgment step.

2. A rotational direction change-over control method as defined in claim 1, wherein said ignition position transfer step is carried out in a manner to detect at least one of a temperature of the internal combustion engine and an intake air temperature of the engine, to thereby vary the excessively advanced position depending on a temperature detected so that the excessively advanced position is advanced with the magnitude of a reduction in detected temperature.

3. A rotational direction change-over control method as defined in claim 1, wherein ignition operation by the ignition unit is carried out in the fuel interruption step as well.

4. A rotational direction change-over control method for changing over a rotational direction of a spark-ignition internal combustion engine of the reciprocating piston type including a piston reciprocated in a cylinder and a crank shaft connected to the piston and adapted to be ignited by an ignition unit capable of controlling an ignition position, comprising:

a fuel interruption step of interrupting feed of fuel to the internal combustion engine while keeping a degree of opening of a throttle valve at a level near a degree of opening thereof during idling of the engine so that a rotational speed of the engine may be reduced when it is fed with a reverse command for commanding to reverse a rotational direction of the engine;

an ignition position transfer step of transferring a position at which the ignition unit carries out ignition operation to an excessively advanced position suitable for reversing a rotational direction of the internal combustion engine during a period of time required to permit a rotational speed of the engine to reach a predetermined level during said fuel interruption step;

a rotational direction reverse step of restarting feed of fuel to the internal combustion engine and permitting the ignition unit to carry out ignition operation at the excessively advanced position when a rotational speed of the engine reaches the predetermined level; and a rotational direction judgment step of transferring an ignition position of each of cylinders to a set ignition position set near a top dead center to judge whether reversing of a rotational direction of the engine is succeeded, after said rotational direction reverse step is terminated;

whereby operation of the engine takes place while keeping the rotational direction reversed after success in reversing of the rotational direction is judged in said rotational direction judgment step.

5. A rotational direction change-over control method as defined in claim 4, wherein said ignition position transfer step is carried out in a manner to detect at least one of a temperature of the internal combustion engine and an intake air temperature of the engine, to thereby vary the excessively advanced position depending on a temperature detected so that the excessively advanced position is advanced with the magnitude of a reduction in detected temperature.

6. A rotational direction change-over control method as defined in claim 4, wherein ignition operation by the ignition unit is carried out in the fuel interruption step as well.

7. A rotational direction change-over control method for changing over a rotational direction of a spark-ignition internal combustion engine of the reciprocating piston type including a piston reciprocated in a cylinder and a crank shaft connected to the piston and adapted to be ignited by an ignition unit capable of controlling an ignition position, comprising:

a fuel interruption step of interrupting feed of fuel to the internal combustion engine while keeping a degree of opening of a throttle valve at a level near a degree of opening thereof during idling of the engine so that a rotational speed of the engine may be reduced when it is fed with a reverse command for commanding to reverse a rotational direction of the engine;

an ignition position transfer step of transferring a position at which the ignition unit carries out ignition operation to an excessively advanced position suitable for reversing a rotational direction of the internal combustion engine during a period of time required to permit a rotational speed of the engine to reach a predetermined level during said fuel interruption step;

a rotational direction reverse step of restarting feed of fuel to the internal combustion engine and permitting the ignition unit to carry out ignition operation at the excessively advanced position when a rotational speed of the engine reaches the predetermined level;

a rotational direction judgment step of transferring an ignition position of each of cylinders to a set ignition position set near a top dead center to judge whether reversing of a rotational direction of the engine is succeeded, after said rotational direction reverse step is terminated; and a repeating step of repeating a series of steps form said fuel interruption step to said rotational direction judgement step until success in reversing of a rotational direction of the engine is judged, when a failure in reversing of the rotational direction is judged in said rotational direction judge step;

whereby operation of the engine takes place while keeping the rotational direction reversed after success in reversing of the rotational direction is judged in said rotational direction judgment step.

8. A rotational direction change-over control method as defined in claim 7, wherein the number of times of ignition carried out in said rotational direction reverse step is increased every time when a series of said steps from said fuel interruption step to said rotational direction judgement step is repeated.

9. A rotational direction change-over control method as defined in claim 7, wherein said ignition position transfer step is carried out in a manner to detect at least one of a temperature of the internal combustion engine and an intake air temperature of the engine, to thereby vary the excessively advanced position depending on a temperature detected so that the excessively advanced position is advanced with the magnitude of a reduction in detected temperature.

10. A rotational direction change-over control method as defined in claim 7, wherein ignition operation by the ignition unit is carried out in the fuel interruption step as well.

11. A rotational direction change-over control method for changing over a rotational direction of a spark-ignition internal combustion engine of the reciprocating piston type including a piston reciprocated in a cylinder and a crank shaft connected to the piston and adapted to be ignited by an ignition unit capable of controlling an ignition position, comprising:

a fuel interruption step of interrupting feed of fuel to the internal combustion engine while keeping a degree of opening of a throttle valve at a level near a degree of opening thereof during idling of the engine, to thereby reduce a rotational speed of the engine, when it is fed with a reverse command for commanding to reverse a rotational direction of the engine;

an ignition position transfer step of transferring a position at which the ignition unit carries out ignition operation to an excessively advanced position suitable for reversing a rotational direction of the internal combustion engine during a period of time required to permit a rotational speed of the engine to reach a predetermined level during said fuel interruption step;

a rotational direction reverse step of restarting feed of fuel to the internal combustion engine and permitting the ignition unit to carry out ignition operation at the excessively advanced position when a rotational speed of the engine reaches the predetermined level;

a rotational direction judgment step of transferring an ignition position of each of cylinders to a set ignition position set near a top dead center to judge whether reversing of a rotational direction of the engine is succeeded, after said rotational direction reverse step is terminated; and a repeating step of repeating a series of steps form said fuel interruption step to said rotational direction judgement step until success in reversing of a rotational direction of the engine is judged, so that said excessively advanced position may be further advanced from the previous excessively advanced position every time when a series of said steps is repeated, when a failure in reversing of the rotational direction is judged in said rotational direction judge step;

whereby operation of the engine takes place while keeping the rotational direction reversed after success in reversing of the rotational direction is judged in said rotational direction judgment step.

12. A rotational direction change-over control method as defined in claim 11, wherein the number of times of ignition carried out in said rotational direction reverse step is increased every time when a series of said steps from said fuel interruption step to said rotational direction judgement step is repeated.

13. A rotational direction change-over control method as defined in claim 11, wherein said ignition position transfer step is carried out in a manner to detect at least one of a temperature of the internal combustion engine and an intake air temperature of the engine, to thereby vary the excessively advanced position depending on a temperature detected so that the excessively advanced position is advanced with the magnitude of a reduction in detected temperature.

14. A rotational direction change-over control method as defined in claim 11, wherein ignition operation by the ignition unit is carried out in the fuel interruption step as well.

* * * * *

UNITED STATES PATENT AND TRADEMARK OFFICE

CERTIFICATE OF CORRECTION

PATENT NO. : 6,098,574

DATED : August 8, 2000

INVENTOR(S) : Arakawa et al.

It is certified that error appears in the above-identified patent and that said Letters Patent is hereby corrected as shown below:

Column 8, line 40, delete "a" (second occurrence), and insert --α--.

Column, 8 line 56, delete "a", and insert --α--.

Column 8, line 58, delete "a", and insert --α--.

Column 10, line 56, delete "No", and insert --NO--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*